US006557466B2

(12) United States Patent
Codde et al.

(10) Patent No.: US 6,557,466 B2
(45) Date of Patent: May 6, 2003

(54) CREASE PLOW FOLDER

(75) Inventors: Christopher L. Codde, Cameron Park, CA (US); Christian E. Tammi, Loomis, CA (US)

(73) Assignee: DST Output, Inc., El Dorado Hills, CA (US)

( * ) Notice: Subject to any disclaimer, the term of this patent is extended or adjusted under 35 U.S.C. 154(b) by 16 days.

(21) Appl. No.: 09/756,592

(22) Filed: Jan. 4, 2001

(65) Prior Publication Data

US 2002/0084568 A1 Jul. 4, 2002

(51) Int. Cl.[7] ..... B41F 5/00
(52) U.S. Cl. ..... 101/216; 101/212; 493/442
(58) Field of Search ..... 101/216, 212; 493/440, 442, 453, 459, 357, 360, 178, 183

(56) References Cited

U.S. PATENT DOCUMENTS

| | | | | | |
|---|---|---|---|---|---|
| 3,656,741 | A | * | 4/1972 | Macke et al. | 270/66 |
| 3,799,536 | A | | 3/1974 | Gregoire | 493/179 |
| 4,085,928 | A | * | 4/1978 | Sussman | 270/61 |
| 4,624,653 | A | * | 11/1986 | McBride et al. | 493/127 |
| 4,834,696 | A | | 5/1989 | Marschke | 53/460 |
| 5,004,452 | A | | 4/1991 | Bunch, Jr. | 493/439 |
| 5,047,000 | A | * | 9/1991 | Lester | 493/231 |
| 5,104,366 | A | | 4/1992 | Bunch | 493/359 |
| 5,449,156 | A | | 9/1995 | Gnuechtel et al. | 270/5.02 |
| 5,524,421 | A | | 6/1996 | Nauheimer et al. | 493/411 |
| 5,755,655 | A | | 5/1998 | Bohn et al. | 493/414 |
| 5,769,773 | A | | 6/1998 | De Santo | 493/22 |
| 6,238,328 | B1 | * | 5/2001 | Loppnow et al. | 493/440 |
| 6,353,726 | B1 | * | 3/2002 | Murata et al. | 339/407 |

* cited by examiner

*Primary Examiner*—Anthony H. Nguyen
(74) *Attorney, Agent, or Firm*—James M. Ritchey

(57) ABSTRACT

A crease plow folder for folding a sheet or continuous web of sheets comprises a non-twisting, holding and transporting mechanism for holding and transporting the sheet or continuous web of sheets in a non-twisting fashion during folding of the sheet. The crease plow folder first creates, at a score line in the sheet or sheets, a rolling fold by directing the sheet or sheets between a centerline-twisted bar and a pressure bar. The rolling fold is then converted into a creased fold by moving the sheet or sheets between a crease roller and an idler roller, thereby generating a change in direction that results in the crease. A controller and associated sensors are included for monitoring the progress of the sheet through the plow folder and for detecting any skewing of an entering sheet.

5 Claims, 8 Drawing Sheets

CREASE PLOW FOLDER

BACKGROUND OF THE INVENTION

1. Field of the Invention

The present apparatus relates to a sheet folding device. More particularly, the subject invention is a crease plow folder that folds cut sheet material or pre-cut continuous web material along a weakened fold-line by first generating a rolled fold around a creasing bar and then changing the direction of the material to buckle the rolled fold and crease it on the weakened fold-line.

2. Description of the Background Art

Traditional "plow folders" have existed for many years and comprise, in general, a cork-screw or helical mechanism that directly generates a fold as the item is transported through the cork-screw mechanism. Usually, the traditional type plow folders produce a crease by forcing the item over a plate as a cork-screw twisting action proceeds.

In particular, U.S. Pat. No. 5,004,452 depicts a device that folds on transverse lines of weakening found in an item to be folded by using an oscillating chute and rotating cams. Focus is drawn to the nature of the exact synchronization scheme utilized in the '452 invention. The apparatus displayed is not capable of folding individual cut sheets of stock paper.

The device related in U.S. Pat. No. 4,834,696 uses pivoting fold contactors to fold the stock paper as it travels down a pathway. The utilized contactors move in an oscillating wave motion. The '696 apparatus is not capable of folding a continuous web of paper and the cut stock paper must be spaced some minimum distance apart. As seen below, the subject apparatus of this current disclosure, as opposed to the one in '696, uses fixed guides, and is capable of folding continuous webs of paper (although not required, usually, the webs are pre-cut before entry into the subject device) or cut sheets of paper with or without spacing and is even capable of folding overlapped individual sheets.

For U.S. Pat. No. 5,449,156, a device is presented that is used to fold continuous web stock paper. The device is not capable of folding individual cut sheets. The disclosed '156 device stresses the generation of a web tension method, but the folding section description does not show much detail.

The method of U.S. Pat. No. 5,769,773 applies to continuous web pages and does not present a folding scheme. The disclosure mentions standard plow or gate folder technologies.

A continuous web of paper is pulled through the folding device described in U.S. Pat. No. 5,524,421. The '421 apparatus does not fold cut sheets and unfolded sheets are not transport through it. Additionally, the device requires web tension to crease and square the fold.

Only continuous web materials are folded by the apparatus shown in U.S. Pat. No. 5,755,655. The '655 device must have the web pulled through to fold and crease the forms. It uses a single point contact to fold 90°, then the web tension finishes the fold and the output rollers crease the fold.

U.S. Pat. No. 3,799,536 also shows a device that requires continuous web tension to pull the stock paper past the folding plate. This device lacks the capability of being able to fold individual sheets of paper.

Described in U.S. Pat. No. 5,104,366 is a device similar to one noted in '452 above and is used to fold continuous web sheets along transverse lines. This invention defines a scheme for folding forms with the top sheet of each form in a common orientation independent of the number of pages in the form. It is not capable of folding cut sheets nor can it fold sheets longitudinally.

U.S. Pat. No. 4,624,653 describes a corner laminating apparatus for folding cartons. Included in this device is a pair of opposing spiral roller supports. The spiraled rollers passively force carton sides to fold at desired locations. Conveyor chains with associated lugs transport the cartons through the folding device. Specifically, the '653 patent describes a device which moves precut blanks of cardboard from a hopper and folds the corners into posts for strength to allow stacking of the gene rated boxes. The system uses a pushing device to drive the cardboard through the folding bars instead of a conveyor. This would not allow overlapped material and would require a space between each box. This system uses rods and rollers to fold the material in an approximately perpendicular manner. Tighter bends are accomplished by using multiple fold sections. This '653 system folds and creases the material at the same time. In the current subject system the material is rolled and pulled over the crease roller to change its direction which causes the crease. Also, the current subject system is significantly less complicated and applies to individual and relatively thin sheets and not cardboard panels used to produce boxes.

U.S. Pat. No. 4,614,512 relates a sheet folding machine utilized for folding corrugated cardboard into packaging cases. Paired bars or belts are employed to bend opposing sides of the cardboard into folded regions. Specifically, '512 uses spiral bars to twist the flap over the box forcing the side flaps to fold on a pre-made hinge. This mechanism does not use a bar to hold the flat portion and does not roll the fold, but relies on the "hinge" to locate the fold. This requires that the hinge be significantly weaker than the base material and that the base be held firmly in place. This mechanism uses a vacuum belt to transport the material and therefore requires that the material be non-porous and have few holes. The current subject folder can fold porous materials with large holes. A critical difference between the current subject folder and this folder is that the '512 folder creases the fold while it is folding whereas the current subject folder rolls the fold first and then the change of direction around the crease roller creases the fold. The '512 patent notes the disadvantage of folding crossways using the spiral bars. The current subject invention eliminates this problem by first rolling the fold around the crease bar and then changing the direction to buckle the fold and crease it on the perforation.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teaches or renders obvious, singly or when considered in combination, applicant's claimed invention.

SUMMARY OF THE INVENTION

An object of the present invention is to provide a crease plow folder that is capable of folding continuous webs of paper (preferably pre-cut before entry into the subject apparatus) or cut sheets of paper with or without spacing and is even capable of folding overlapped individual sheets.

Another object of the present invention is to furnish a crease plow folder that produces in a desired sheet an initial rolled fold and then a final crease.

A further object of the present invention is to supply a crease plow folder that comprises a non-twist holding and transporting means that delivers a sheet into an initial roll folding means and then a final creasing means.

Still another object of the present invention is to disclose a crease improved plow folder that is capable of folding continuous webs of paper (usually, though not exclusively pre-cut) or cut sheets of paper with or without spacing and is even capable of folding overlapped individual sheets by utilizing a non-twist holding and transporting means that delivers the paper into an initial roll folding means and then a final creasing means.

Yet a further object of the present invention is to describe a sheet folding device that comprises a non-twist sheet holding and transporting means, an initial roll fold generating means, a final crease fold producing means, and sheet alignment tracking means that include a skew-sensor.

Disclosed is a plow folder device engineered to fold sheet stock having a perforated or otherwise weakened fold line. The subject apparatus can be used with cut sheet material or continuous web material. (preferably pre-cut before folding begins). Additionally, it can be setup to transport flat sheet stock without folding, if that is required. The subject invention's induced fold in a sheet requires some type of weakened fold line. One acceptable method is to employ perforated form stock. Another acceptable method is by adding a perforation or crease generating wheel to the input device.

A portion of the subject plow folding device is designed to accurately hold stock in a fixed orientation without allowing it to twist. The non-twist holding is accomplished by using means comprised of multiple rollers securely attached directly or indirectly to each other and turning at approximately or essentially the same speed, preferably, the same speed. These rollers apply very low forces to the paper at two or multiple positions on the surface. Thus, these rollers transport the paper without applying any significant twisting motion or force. Each sheet is not allowed to twist since that would cause skidding between the sheet and the rollers.

In one embodiment of the subject invention each sheet is fed out of a cutter into the tension rollers. The sheet is still attached to the web at the trailing end. The tension rollers maintain a slight tension on the sheet keeping it flat without allowing it to twist. After the sheet is cut to length it is gently accelerated and transported into the folding section.

An alternative embodiment for the input device is an individual sheet feeder or another type of continuous web to cut sheet device that accurately positions the included fold line. It is noted that if the subject folder were used to fold a continuous web, the tension device would not be required.

The rolling fold portion of the plow folding device uses a generally rectangular bar twisted about its own centerline. This type of construction is relatively easy to produce and allows the folding to be very close to the desired fold line.

The subject folder initially rolls the sheet like a half-tube along the fold line. This action causes the sheet to roll over onto itself without buckling or creasing the fold, thus, allowing the edges of the folded portion to align with the unfolded portion before the creasing operation. By concentrating the folding twist to an area very near the fold line the forces on the folded portion are minimized and the folded portion remains planer with the exception of the rolled portion. To crease the rolled fold the rolled sheet is pulled around a roller driven at the sheet speed. When the sheet begins to change direction around the roller the rolled portions of the sheet moves toward the pitch line of the crease roller in order to maintain a constant sheet speed. This action causes the outer portion of the rolled tube to move in and the inner portion of the roll to move out and forces the sheet to buckle on the weakened fold line. A tapered roller with clearance on the inboard side is utilized to change the sheet direction. This clearance allows the folded sheet to move and align without being captured by the roller.

The transport rollers are supported from one side leaving the system open on an operator side to ease jam removal. In addition, the subject system uses an open design to eliminate paper build up, minimize the transfer of ink and toner, and eliminate the effect of static drag on the paper.

Appropriately positioned sensors to detect sheet twist and skewing. The sensors measure the position of the leading edge of the sheets and if a sheet enters the folder skewed beyond a predetermined maximum amount, the sheet is stopped. This sensor system minimizes the number of damaged sheets and stops the system before it jams. An operator may correct the problem and restart the device quickly.

Conveniently, the subject device can be integrated with many different types of input and output devices because of an input tension roller device, an independent drive system, and a driven output roller system.

Other objects, advantages, and novel features of the present invention will become apparent from the detailed description that follows, when considered in conjunction with the associated drawings.

DESCRIPTION OF THE PREFERRED EMBODIMENT

Figure 1:
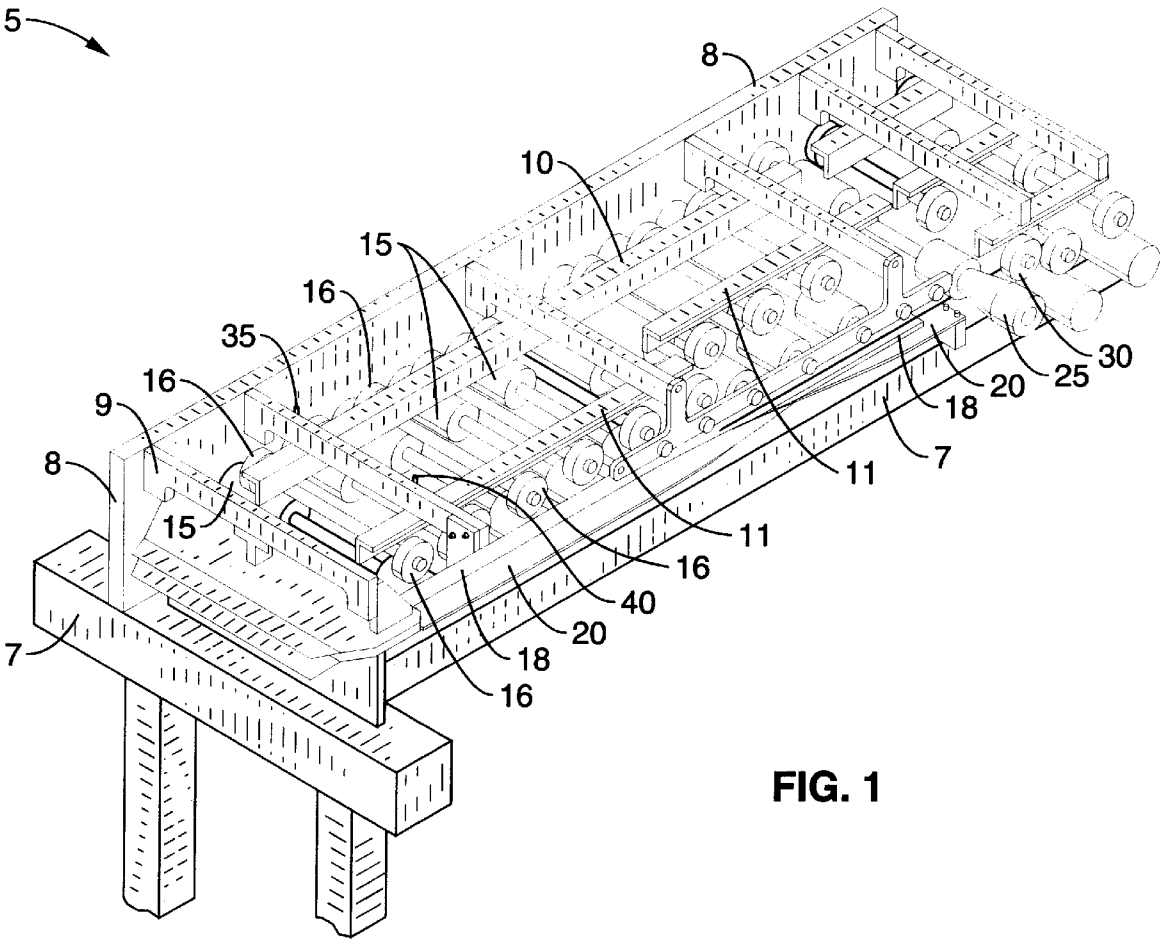
FIG. 1 is a perspective view of the subject invention.
Figure 2:
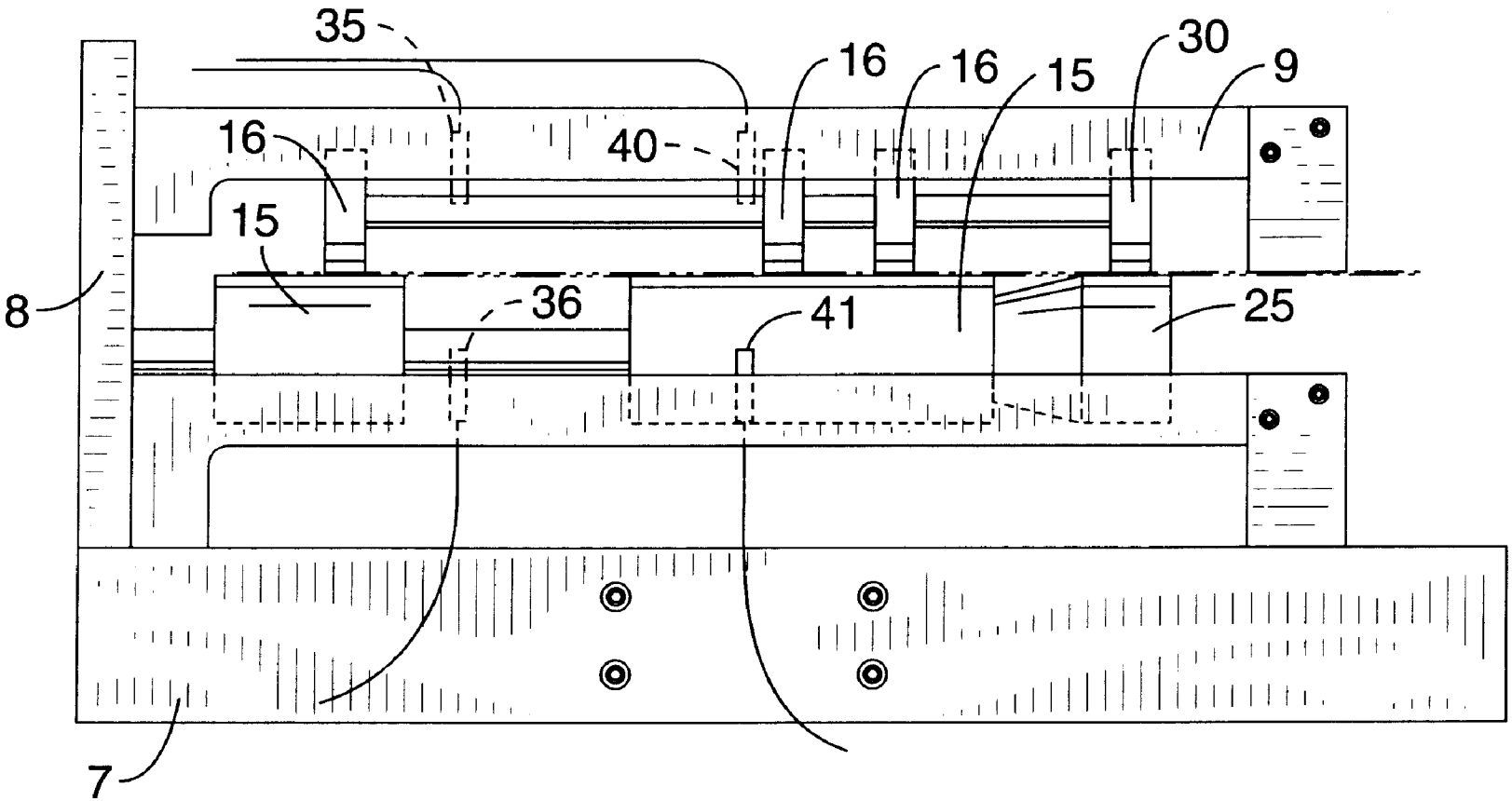
FIG. 2 is an end view of the subject invention showing the locations of associated sensors for detecting sheet alignment.

The subject invention, an improved variation of a standard plow folder, has several unique, novel, and non-obvious features that are illustrated in FIGS. 1–9. The subject device 5 is designed to fold sheet stock (in the associated figures, a sheet is designated by "S"), usually paper, having a perforated or otherwise weakened fold line generally located in the about top quarter of the sheet. A suitably structured frame 7 and side panel 8 support the components of the subject invention. The first section of the subject plow folding device is designed to accurately hold and transport stock in a fixed orientation without allowing it to twist during the folding process. The non-twist holding and transporting is accomplished by using means comprising multiple rollers. In particular, a plurality of drive rollers 15 are coupled or attached to each other and turning at the same speed. Paired with the drive rollers 15 are multiple idler rollers 16 that passively press against the drive rollers 15 to hold the transported stock. These drive and passive rollers 15 and 16 come after the tension rollers, if tension rollers are utilized in the particular configuration. Standard means for accomplishing the coupling of the drive rollers 15 are utilized and include belts, chains, linkages, and similar mechanisms (not shown). The constant speed is produced by one or more associated standard motor drives that are either fixed at one speed or variable to selected speeds and under the regulation of a central control means (see FIG. 9). The rollers 15 and 16 are mounted to the frame 7 and side panel 8 by conventional means, including appropriate axles and bearings, adapted for either the drive roller 15 or idler roller 16 configurations. The roller 15 and 16 mountings usually include cross-braces 9 and elongated bracing members 10 and 11 to stabilize the assembly. The rollers 15 and 16 apply very low forces to the paper at two positions (for cut sheets and not continuous form/sheets/web) on the surface (one large pressure area is within the realm of this disclosure, as are more pressure positions than two, however, two positions are preferred.). These rollers 15 and 16 transport the paper without applying any twisting moment, thus, each sheet is not allowed to twist since that would cause skidding between the sheet and the rollers.

In one embodiment of the subject invention each sheet is fed out of a cutter (place before the subject invention) into the tension rollers (not shown) where it is held lightly. The sheet is still attached to the web at the trailing end. The tension rollers maintain a slight tension on the sheet keeping it flat without allowing it to twist. After the sheet is cut to length, by an appropriate standard means, it is gently accelerated and transported into the folding section by the non-twist holding and transporting means (paired rollers 15 and 16).

An alternative embodiment for the input device is an individual sheet feeder or another type of continuous web to cut sheet device that accurately positions the fold line, before the subject invention. It is noted that if the subject folder were used to fold a continuous web the tension device would not be required.

Figure 3:
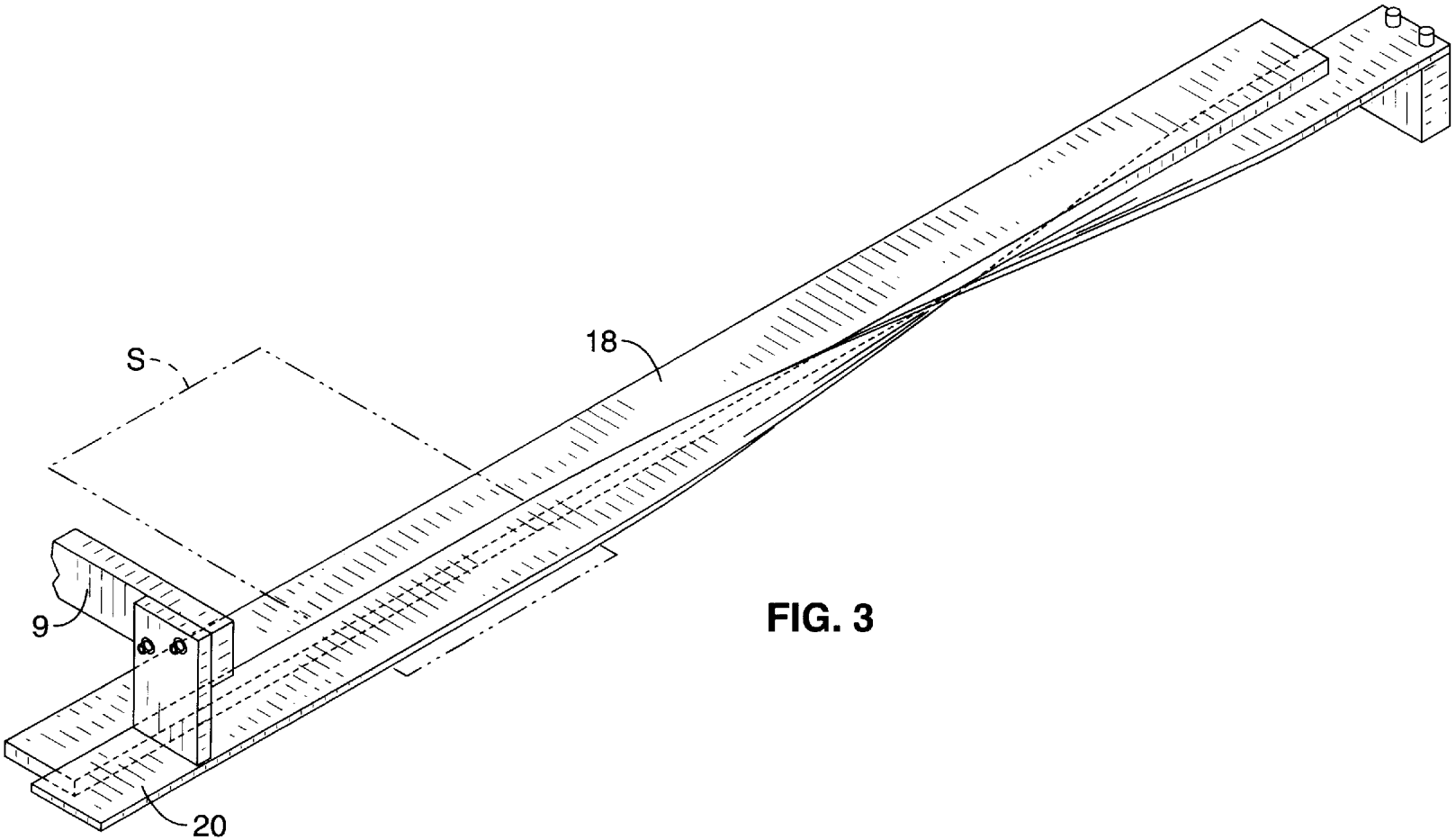
FIG. 3 is a perspective view displaying the rolling fold bar of the subject invention and the orientation of a sheet to be folded.
Figure 4:
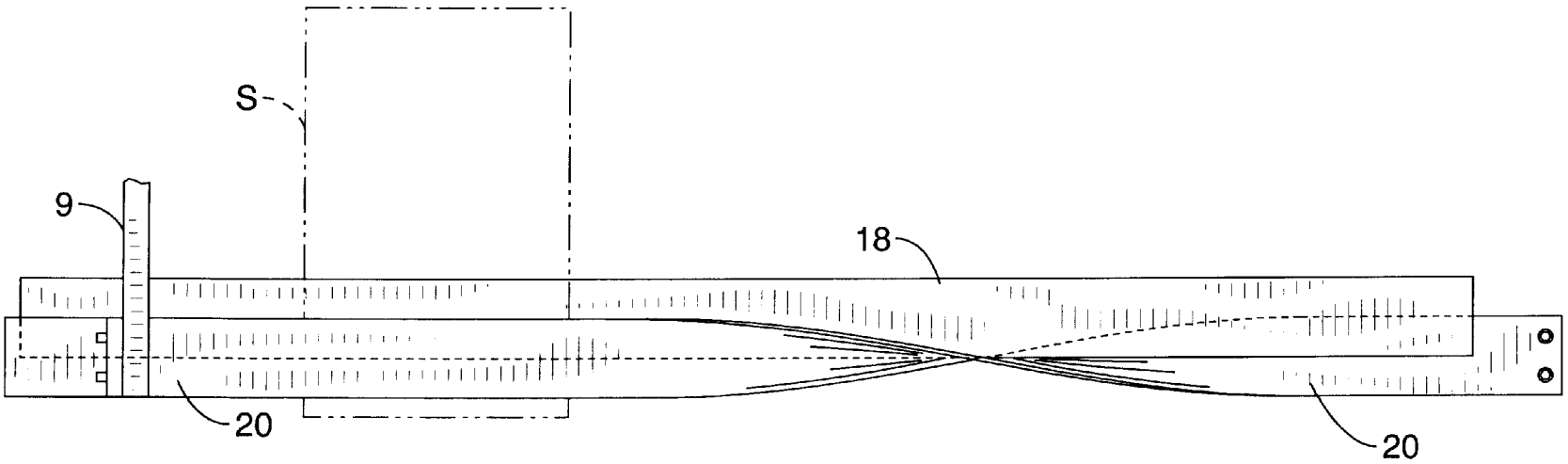
FIG. 4 is a top view of the rolling fold bar of the subject invention and the orientation of a sheet to be folded.

The non-twist rolling fold producing means of the subject plow folding device 5 usually uses an elongated and generally flattened pressure bar 18 and a centerline-twisted and generally rectangular folding bar 20 (as clearly seen in FIGS. 3 and 4). In addition to the specific configurations shown in FIGS. 1–4, other suitable variations for both components 18 and 20 are contemplated as being within the realm of this disclosure including, but not limited to oval, circular, and the like, as long as a rolling fold is generated in the stock. Both components 18 and 20 can be fabricated from plastic, metal, or equivalent materials. Folding bar 20 is twisted about its own centerline. This type of construction is less expensive and more accurate than a "cork screw" shape (normally with an internal open axial volume) and allows the folding to be very close to the desired fold line. To assist in producing an exactly positioned fold line, the sheet S to be folded usually includes a score line SC which partially weakens the sheet S at that position.

Figure 5E:
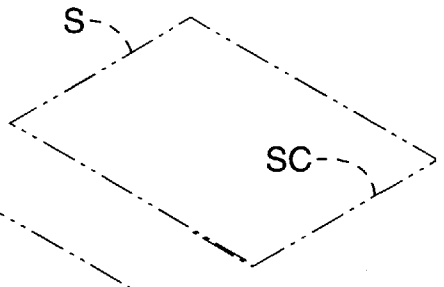
FIGS. 5A–5E depict a typical sheet being folded by the subject invention, wherein the sheet first undergoes a rolling fold (FIGS. 5A–5D) and a then a final creasing fold (FIG. 5E).
Figure 5D:
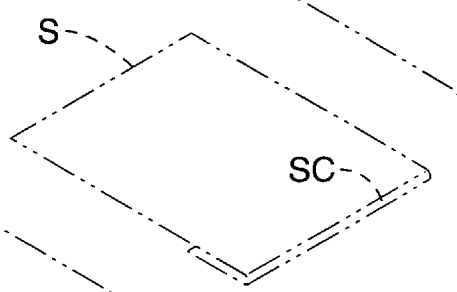
Figure 5C:
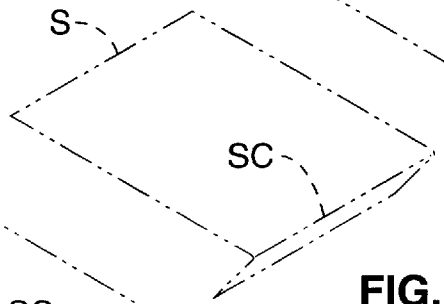
Figure 5B:
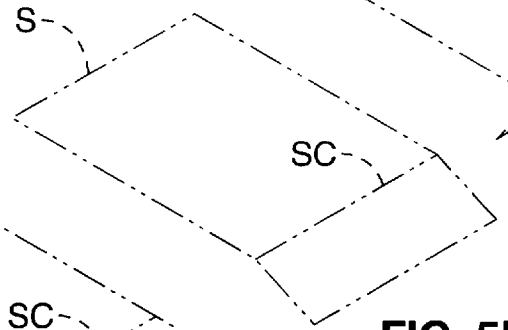
Figure 5A:
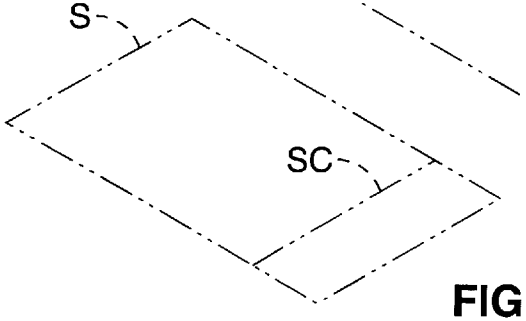
Figure 6:
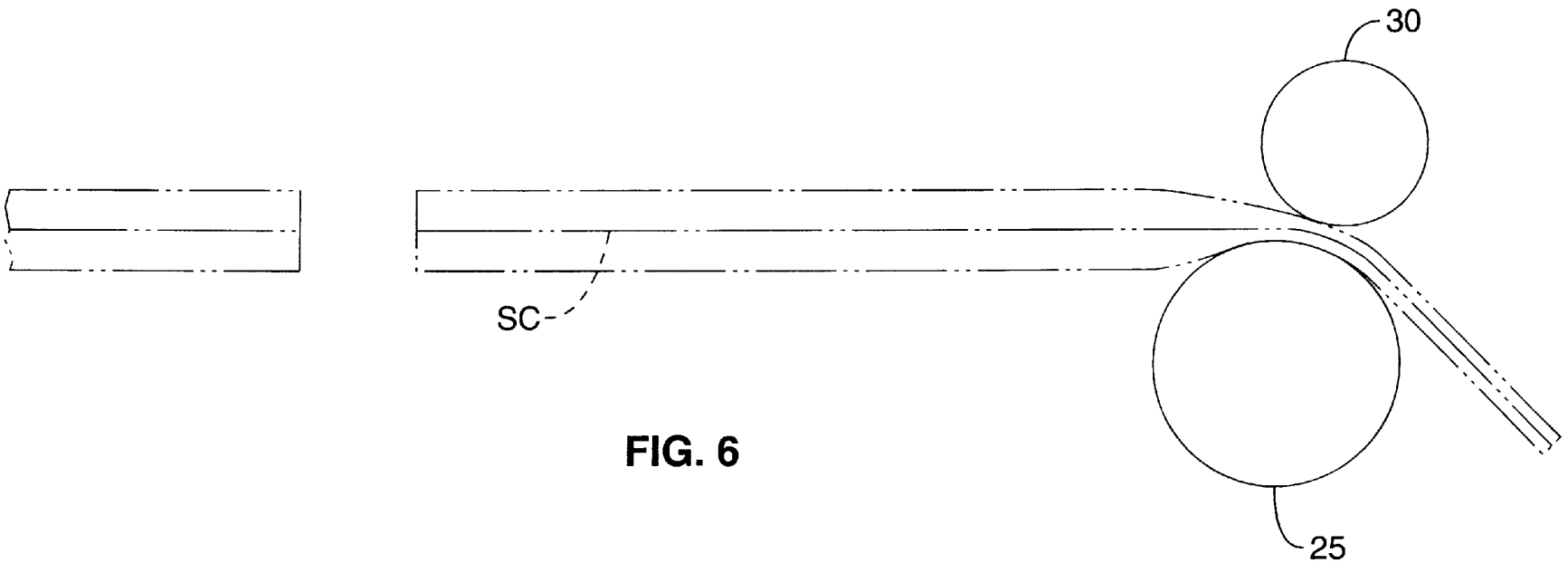
FIG. 6 is a side view of the rolled fold of a sheet being converted into a final creased fold by the creasing means that includes a crease roller and an idle roller.

The subject invention 5 incorporates this centerline-twisted bar 20 and paired flat pressure bar 18 in a unique manner not seen in the known prior art. Attention is brought to the fact that the improved subject plow folding device 5 differs from other earlier plow folders by initially rolling the sheet of stock like a half-tube instead of sharply creasing the fold over a plate (this round fold to creased fold mechanism and process are shown in FIGS. 4, 5, and 6). FIG. 5 shows the process of first roll-folding the sheet S (FIGS. 5A to 5D) and then creasing the sheet S (FIG. 5E). This net result of the subject two-step process is that each sheet S rolls over onto itself along the score line SC without buckling or creasing at the roll fold, thus, allowing the edges of the roll folded portion to align with the unfolded portion before the final sharp creasing operation. Further, by concentrating the folding roll/twist to an area very near the scored fold line the forces on the folded portion are minimized and the folded portion remains planer with the rolled-over portion neatly aligning with the body of the sheet S (FIG. 5D).

To crease the rolled fold along the score line SC into the final folded form (FIG. 5D to FIG. 5E), the rolled fold sheet S is pulled around and through a folding or crease roller 25 driven at the sheet speed (same rotational speed as the holding and transporting rollers 15 and 16) and a idler roller 30. When the sheet S begins to change-direction around the crease roller 25, the rolled portion of the sheet S moves toward the pitch line of the crease roller 25 in order to maintain a constant sheet speed. This action causes the outer portion of the rolled tube fold to move in and the inner portion of the rolled tube fold to move out and forces the sheet S to buckle on the weakened fold line SC. Usually, the crease roller 25 comprises a tapered roller with clearance on the inboard side to change the sheet S direction. This clearance allows the roll folded sheet S to move and align without actually being captured by the rollers 25 and 30. The fold crease is accomplished by the direction change instead of using a roller system that "pinches" to create the crease. Specifically, the rolled fold to creased fold transition is seen in FIG. 6 where the rolled fold precedes (to the left of) the paired crease rollers 25 and 30 and the creased fold exits (to the right of) the paired crease rollers 25 and 30. Note the change in direction of the sheet S before and after the paired crease rollers 25 and 30.

Preferably, the subject folding system 5 is configured with the transport rollers 15 and 16 supported from one side of the frame side panel 8 leaving the system open on an operator side to ease jam removal. In addition, the subject system uses an open design to eliminate paper build up, minimize the transfer of ink and toner, and eliminate the effect of static drag on the paper.

The subject device 5 can be integrated with many different types of input and output devices because of the input tension roller configuration, independent drive system, and the driven output roller system. It can be used with cut sheet material or continuous web material. Additionally, it can be setup or adjusted to transport flat sheet stock without folding, if that is required.

The subject invention 5 induced fold requires some type of weakened fold line or score line SC in the sheet S to be folded. One acceptable method is to employ perforated form stock. Although other score line SC generating means are contemplated, the scoring could also be accomplished by adding a perforation or crease wheel to an input device (not shown).

Figure 7:
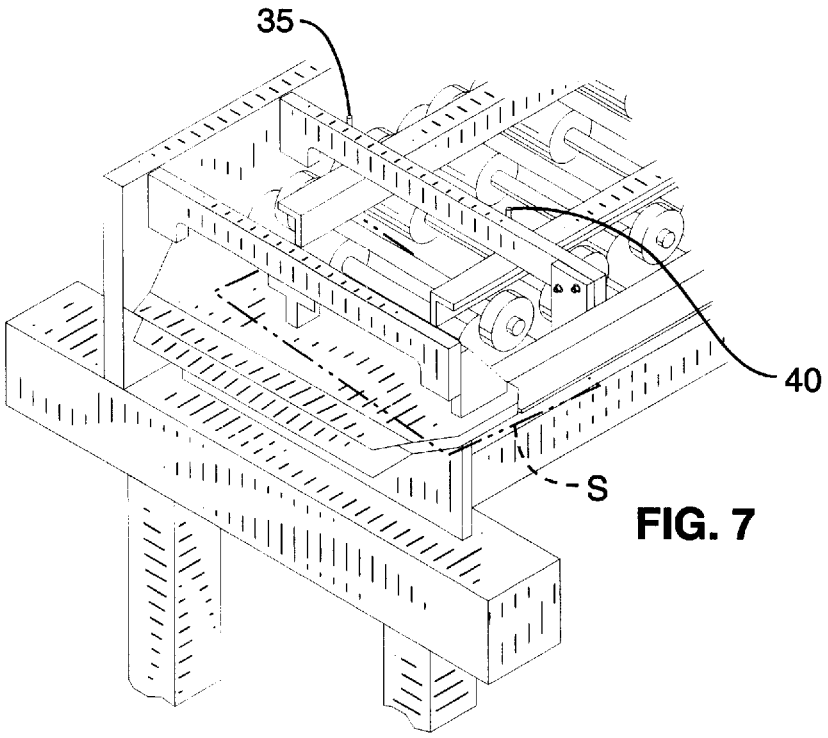
FIG. 7 is a perspective partial view of the subject invention depicting a sheet that improperly aligned.
Figure 8:
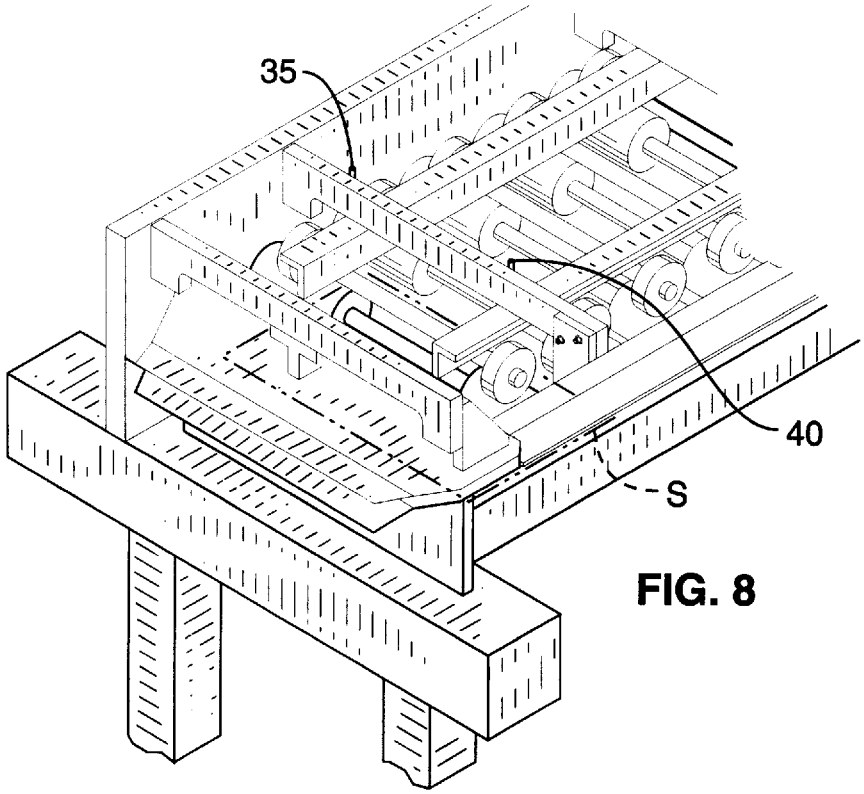
FIG. 8 is a perspective partial view of the subject invention showing a sheet that properly aligned before the rolling fold is initiated.

Also, the subject plow folder 5 uses sensors to detect sheet twist and skewing. Suitable sensors include light emitting devices, mechanical means, and equivalent systems. These sensors (preferably paired emitter/receiver sensors 35/36 and 40/41 that are depicted in FIGS. 1, 2, 7, and 8) measure the position of the leading edge of the sheets, as interpreted by a controller (the controller being a suitably programmed computer or the equivalent that is interfaced to the sensors and folder, FIG. 9). If the sheet S entering the folder 5 is skewed beyond the selectable maximum allowed (as seen in FIG. 7), the sensors detect this misalignment and the sheet S is stopped before folding by the central controller that is programmed with acceptable parameters of skewing. A properly aligned sheet S (as seen in FIG. 8) would proceed through the subject folder without being halted by the controller. The subject sensor system minimizes the number of damaged sheets and stops the system 5 before it jams. Further, the subject system allows the operator to correct the problem and restart the device as soon as possible.

As indicated immediately above, the subject plow folder 5 uses a pair computer-coupled of light emitting and receiving sensors 35/35 and 40/41 (seen completely in FIG. 2 and partially in FIGS. 1, 7, and 8) to detect twist, skewing, and an incorrectly cut sheet S. These sensors 35/36 and 40/41, in conjunction with the included controller, measure the position of the leading and trailing edges of the sheets as they enter the plow folder. If the sheet S entering the folder is skewed beyond the maximum allowed (a variable parameter that is programmed into the subject controller) or the sheet S is cut to the wrong size or shape the system is programmed to stop immediately. Every sheet S that enters the subject folder 5 is checked, thereby minimizing the number of damaged output products entering a following system. Jams are also eliminated by not allowing incorrect (size variations) sheets S to enter the folder 5. This allows the operator to correct the problem and restart the system as soon as possible.

Tension rollers at the input to the subject folder 5 gently hold the sheet S (at this point the sheet S is still free to move slightly). As the sheet S enters the urethane holding/transporting rollers 15 and 16 it is held tightly and no longer allowed to move. The skew sensors 35/36 and 40/41 are located immediately beyond the first pinch/contact point of the holding/transporting rollers 15 and 16, usually, with the emitter 35 and 40 mounted above the paper path and the receiver 36 and 41 mounted below (although the reverse orientation is acceptable). The sensors 35/36 and 40/41 are mounted inline, perpendicular to the direction of sheet S travel. In an exemplary application, the sensor 40/41 nearest the fold is identified as the "Top of Form" (TOF) sensor and the other sensor 35/36 is the "Bottom of Form" (BOF) sensor. The sheet S passes between the two parts of the sensor 35/36 and 40/41, isolating one from the other. The sensors 35/36 and 40/41 ensure that the sheet S being held and transported through the folder 5 is oriented correctly.

Figure 9:
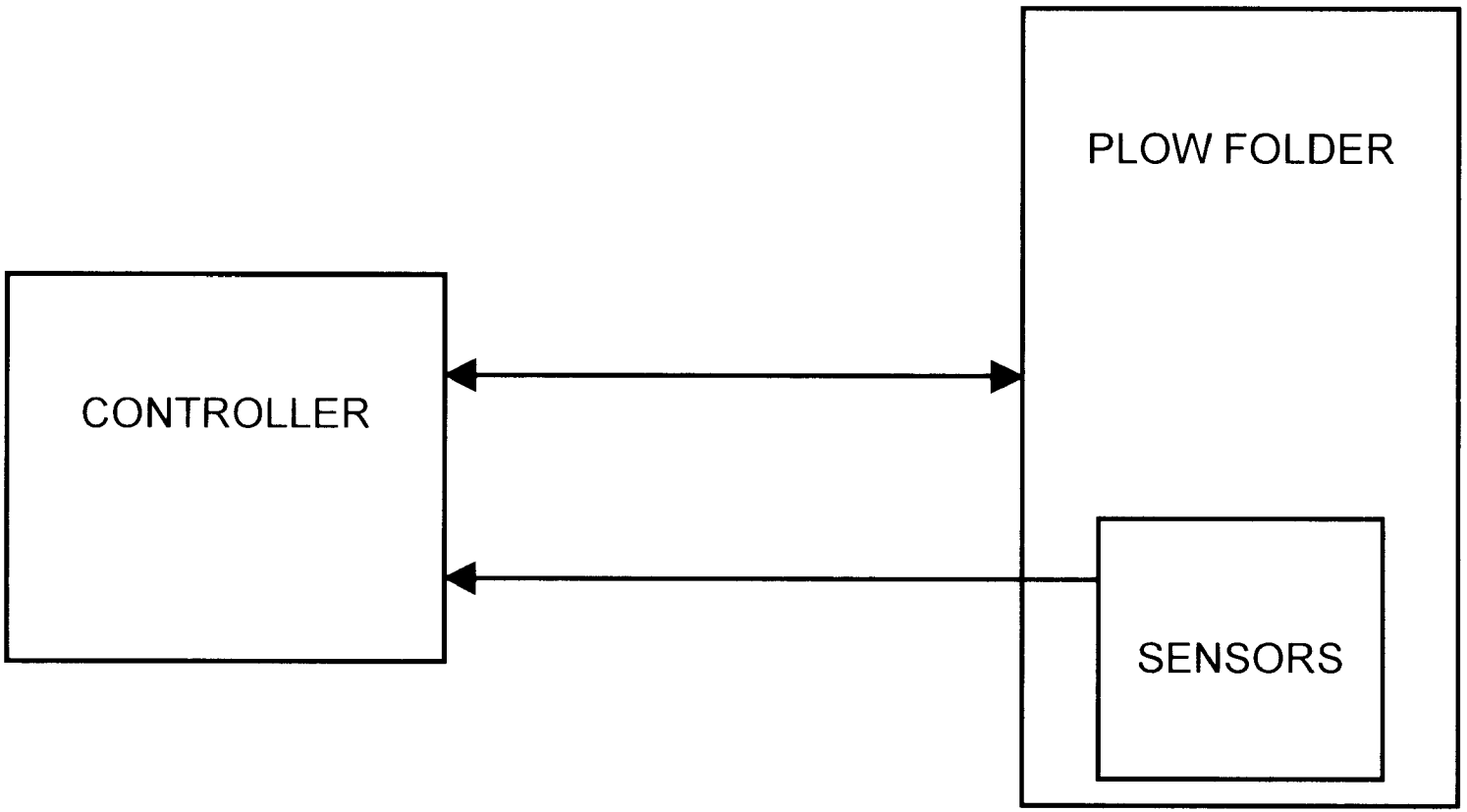
FIG. 9 is a block diagram of the subject invention showing the interrelationship between the subject plow folder, with the associated sensors, and the controller.

Preferably, the sensors 35/36 and 40/41 are of a photoelectric type in a through-beam configuration. The sensors' light emitter and light receiver elements are aligned so that the beam of light travels across the target zone (the path of the sheet S) from the emitter 35 and 40 to the receiver 36 and 41. These sensors 35/36 and 40/41, in conjunction with the interfaced subject controller, detect changes in the light intensity between the emitter 35 and 40 and receiver 36 and 41. FIG. 9 depicts a block diagram of the controller/plow folder/sensors interrelationship in which the folder associated sensors send information to the controller and the controller monitors and controls the subject plow folder. A remote mounted amplifier (included in the associated controller shown in FIG. 9) compares the intensity with a preset value and outputs a signal when the value has been exceeded (indicating the presence of an error in the system). Usually, fiber optic cables are used to route the light between the target zone and the sensor's emitting and receiving elements and the amplifier.

The sensors 35/36 and 40/41 are calibrated to signal the control computer when a sheet S of any thickness interrupts the light beam flowing between sensors' emitters 35 and 40 and the receivers 36 and 41. The interrupt indicates that the leading edge of the sheet S has entered the folder. When the light beam is restored the sensors again signal the control computer, indicating that the trailing edge of the sheet S has entered the folder.

The blocking and clearing of each sensor 35/36 and 40/41 is used to detect the leading and trailing edge of the sheet S as it travels through the subject plow folder 5. Using an optical encoder attached to the folder 5 drive motor, the controller, via associated programming, knows the exact position at which each sensor 35/36 and 40/41 blocks and clears. For each sheet S that passes through the sensors 35/36 and 40/41, the controller calculates the relative distance between the block position for the TOF 40/41 and BOF 35/36 sensors. This distance reflects any sheet S skewing that might exist. If the sheet skewing value is outside of a configured range, the controller stops the system 5 and reports an error. The same scheme is utilized, via controller programming, to measure the size and shape of the paper using the clearing of both sensors 35/36 and 40/41. The calculated distance from blocking of the sensor 35/36 and 40/41 to clearing of the sensor is used to verify the sheet S length. The system is stopped if this length does not match the preset configured value.

By way of example only and not by way of limitation, a typical set of controller instructions, in relation to the included sensors 35/36 and 40/41, comprises:

1. Wait for a break/block on either sensor and record the position.
2. Wait for a break/block on the other sensor and record the position.
3. If the difference in sensor positions is greater than a pre-selected maximum skew, display an error message and stop the system, otherwise, 4. Wait for a make on either sensor and record the position.
5. Wait for a make on the other sensor and record the position.
6. If the difference in positions is greater than a pre-selected maximum skew, display error message and stop the system.

otherwise

7. If the difference from break/block to make is outside the range of the page width, including a +/− configured variance, display an error message and stop the system.

The invention has now been explained with reference to specific embodiments. Other embodiments will be suggested to those of ordinary skill in the appropriate art upon review of the present specification. Although the foregoing invention has been described in some detail by way of illustration and example for purposes of clarity of understanding, it will be obvious that certain changes and modifications may be practiced within the scope of the appended claims.

What is claimed is:

1. A crease plow folder for folding a sheet, comprising:

a) non-twisting, holding and transporting means for holding and transporting the sheet in a non-twisting fashion during folding of the sheet, wherein said non-twisting, holding and transporting means comprises:

i) a plurality of drive rollers, wherein each of said plurality of drive rollers rotates at essentially the same constant rotational speed and ii) a plurality of idler rollers, wherein said plurality of drive rollers are paired with said plurality of idler rollers, thereby minimizing twisting forces on the sheet;

b) rolling fold means for producing a rolling fold at a desired location in the sheet, wherein said rolling fold means comprises:

i) a centerline-twisted bar and ii) a paired pressure bar positioned adjacent said pluralities of drive and idler rollers;

c) creasing means for converting the rolling fold into a creased fold; and d) controller means for monitoring the progress of the sheet through the plow folder.

2. A crease plow folder according to claim 1, wherein said creasing means comprises:

a) an idler roller and b) a crease roller, wherein said idler roller and said crease roller are immediately after said plurality of rollers and said adjacent centerline-twisted bar and alter the direction of the sheet, thereby producing a crease in a previously roll folded sheet.

3. A crease plow folder for use with a scored sheet, comprising:

a) non-twisting, holding and transporting means for holding and transporting the scored sheet in a correctly oriented and non-twisting alignment while the scored sheet is folded, wherein said non-twisting, holding and transporting means comprises:

i) a plurality of drive rollers, wherein each of said plurality of drive rollers rotates at essentially the same constant rotational speed and ii) a plurality of idler rollers, wherein said plurality of drive rollers are paired with said plurality of idler rollers, thereby minimizing twisting forces on the sheet;

b) rolling fold means for producing a rolling fold at a score line in the scored sheet, wherein said rolling fold means comprises:

i) a centerline-twisted bar and ii) a paired pressure bar positioned adjacent said pluralities of drive and idler rollers;

c) creasing means for converting the rolling fold into a creased fold; and d) controller means for monitoring the progress and alignment of the scored sheet through the plow folder.

4. A crease plow folder according to claim 3, wherein said creasing means comprises:

a) a creasing idler roller and b) an inwardly tapered crease roller, wherein said creasing idler roller and said inwardly tapered crease roller are positioned immediately after said pluralities of driver and idler rollers and said adjacent centerline-twisted bar and alter the direction of the sheet, thereby producing a crease in a previously roll folded sheet.

5. A crease plow folder for use with a scored sheet of paper stock, comprising:

a) an elongated frame having first and second ends;

b) a plurality of paired rollers beginning proximate said elongated frame first end, wherein said plurality of paired rollers are coupled to one another and turning at the same speed, thereby holding and transporting, between said paired rollers, the scored sheet in a non-twisting and correctly oriented manner said plurality of paired rollers including a plurality of drive rollers and a plurality of idler rollers;

c) a centerline-twisted bar and paired pressure bar secured to said elongated frame and positioned adjacent said plurality of paired rollers for producing a rolling fold at a score line in the scored sheet;

d) creasing means for converting the rolling fold into a creased fold, wherein said creasing means comprises:

i) a creasing idler roller and ii) an inwardly tapered crease roller, wherein said creasing idler roller and said inwardly tapered crease roller are rotationally affixed to said elongated frame and positioned immediately after said pluralities of paired driver and idler rollers and said adjacent centerline-twisted bar and alter the direction of the sheet, thereby producing a crease in a previously roll folded sheet; and e) controller means for monitoring the progress of the scored sheet through the plow folder, wherein said controller means comprises:

i) skew sensor means and ii) sheet location monitoring means.

* * * * *